US011629523B1

(12) United States Patent
Marks

(10) Patent No.: US 11,629,523 B1
(45) Date of Patent: Apr. 18, 2023

(54) FENCE WITH ONE WAY VIEWING INSERT

(71) Applicant: Jason Marks, Montross, VA (US)

(72) Inventor: Jason Marks, Montross, VA (US)

( * ) Notice: Subject to any disclaimer, the term of this patent is extended or adjusted under 35 U.S.C. 154(b) by 191 days.

(21) Appl. No.: 17/222,065

(22) Filed: Apr. 5, 2021

(51) Int. Cl.
*E04H 17/16* (2006.01)
*E04H 17/20* (2006.01)

(52) U.S. Cl.
CPC ..... *E04H 17/168* (2013.01); *E04H 17/21* (2021.01)

(58) Field of Classification Search
CPC ... E04H 17/165; E04H 17/166; E04H 17/168; E04H 17/21; E04H 17/003; E04H 17/20
See application file for complete search history.

(56) References Cited

U.S. PATENT DOCUMENTS

| | | | | |
|---|---|---|---|---|
| 5,015,119 | A | 5/1991 | Schmanski | |
| 5,233,810 | A * | 8/1993 | Jennings | E04H 17/168 52/745.19 |
| 5,496,016 | A * | 3/1996 | Parisien | E04H 17/143 256/59 |
| 5,925,437 | A | 7/1999 | Nelson | |
| 6,851,660 | B1 * | 2/2005 | Cravatt | E04H 17/168 256/73 |
| 7,032,891 | B2 | 4/2006 | Rowley et al. | |
| 7,090,201 | B2 * | 8/2006 | Brucker | E04H 17/166 256/25 |
| 7,427,433 | B2 * | 9/2008 | Li | D04B 21/12 442/132 |
| 8,366,078 | B2 | 2/2013 | Meglino | |
| 9,963,904 | B1 | 5/2018 | Garcia | |
| 10,105,890 | B2 * | 10/2018 | Kelly | E04C 2/52 |
| 10,190,331 | B2 | 1/2019 | Delafield et al. | |
| 11,499,338 | B2 * | 11/2022 | Amaral | E04H 17/168 |
| 2006/0273502 | A1 * | 12/2006 | Sade | E04H 17/168 269/41 |
| 2010/0314597 | A1 * | 12/2010 | Rodriguez | E04H 17/1447 29/558 |
| 2011/0133145 | A1 * | 6/2011 | Morrow | E04H 17/22 256/65.11 |
| 2014/0054528 | A1 * | 2/2014 | Boggs | E04H 17/16 256/24 |
| 2015/0240517 | A1 * | 8/2015 | Lopez | E04H 4/06 256/65.02 |
| 2022/0145660 | A1 * | 5/2022 | Castellucci | E04H 17/166 |

FOREIGN PATENT DOCUMENTS

| | | | | |
|---|---|---|---|---|
| EP | 0846818 | A1 * | 6/1998 | E04H 17/165 |
| FR | 2862325 | A1 * | 5/2005 | E04H 17/168 |
| WO | WO-2004048720 | A2 * | 6/2004 | E04H 17/003 |

* cited by examiner

*Primary Examiner* — Matthew R McMahon
(74) *Attorney, Agent, or Firm* — Sanchelima & Associates, P.A.; Christian Sanchelima; Jesus Sanchelima

(57) ABSTRACT

A fence with a one-way viewing insert including a domicile assembly, a fence assembly, and a pane assembly. These assemblies in conjunction with one another provide a simple solution for adding privacy to a user's domicile. The fence assembly includes fence posts secured along the perimeter of a domicile. The fence posts having a pane opening to receive the pane assembly. The pane assembly includes a pane with a reflective face and a viewing face located opposite one another. The viewing face of the pane is oriented facing said user's domicile and allows for a user to view through it. Facing away from the user's domicile is the reflective face of the pane. The reflective face preventing viewers from the opposite side of the domicile to view past the pane.

4 Claims, 5 Drawing Sheets

FENCE WITH ONE WAY VIEWING INSERT

BACKGROUND OF THE INVENTION

1. Field of the Invention

The present invention relates to a fence with a one-way viewing insert and, more particularly, to a fence with a one-way viewing insert that includes multiple interchangeable panel inserts.

2. Description of the Related Art

Several designs for a fence with a one-way viewing insert have been designed in the past. None of them, however, include a vertical aperture that can receive panel inserts.

Applicant believes that a related reference corresponds to U.S. Pat. No. 5,015,119 issued for a vision blocking barrier having insertable opaque panels. Applicant believes that another related reference corresponds to U.S. Pat. No. 8,366,078 issued for a privacy system for chain link fences comprising inserts and a locking member for locking and retaining the privacy inserts in the chain link fence. None of these references, however, teach of a fence including a vertical aperture that receives a one-way viewing pane.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a fence with a one-way viewing insert that includes a panel with one-way viewing properties.

It is another object of this invention to provide a fence with a one-way viewing insert that includes a fence assembly with a pane opening that can receive a pane assembly.

It is still another object of the present invention to provide a fence with a one-way viewing insert that increases the privacy of a domicile.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
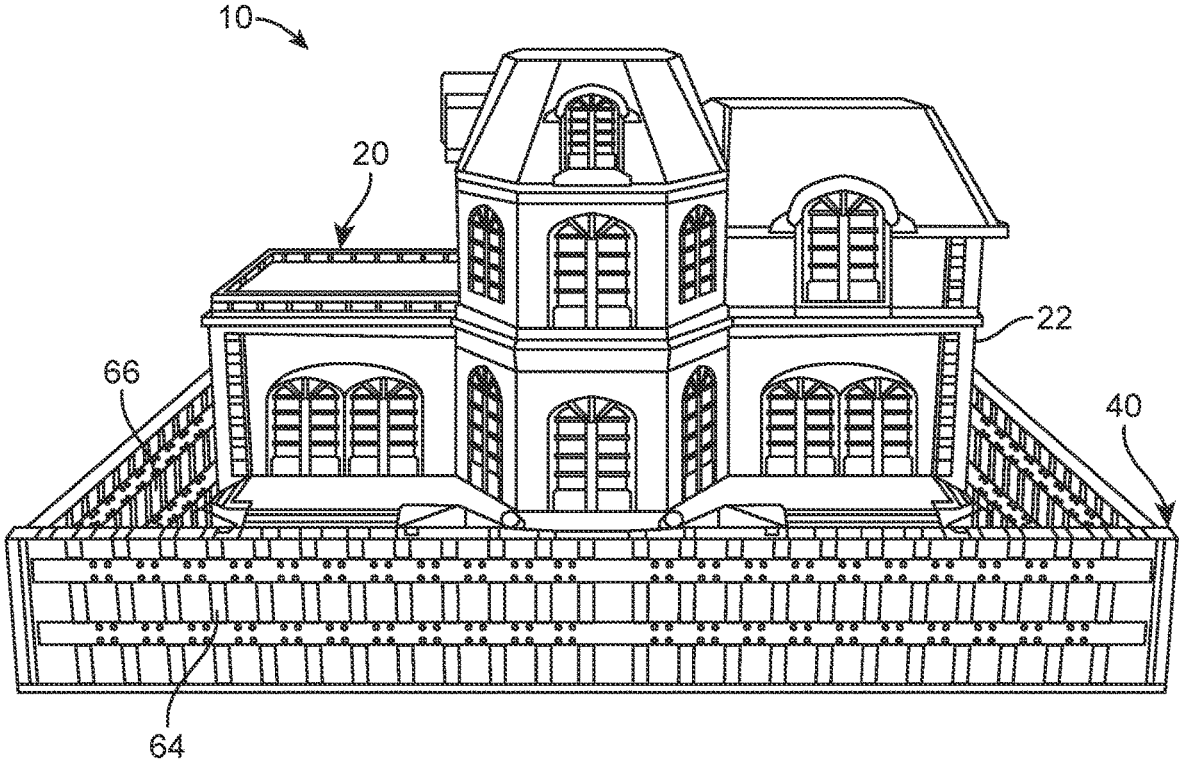
FIG. 1 represents a domicile assembly 20 surrounded by fence assembly 40 with reflective face 64 oriented away from domicile 22.

Referring now to the drawings, where the present invention is generally referred to with numeral 10, it can be observed that it basically includes a domicile assembly 20, a fence assembly 40, and a pane assembly 60.

Best illustrated in FIG. 1 domicile assembly 20 may include a domicile 22. Domicile 22 may denote an area to be enclosed about a perimeter by fence assembly 40.

Figure 2:
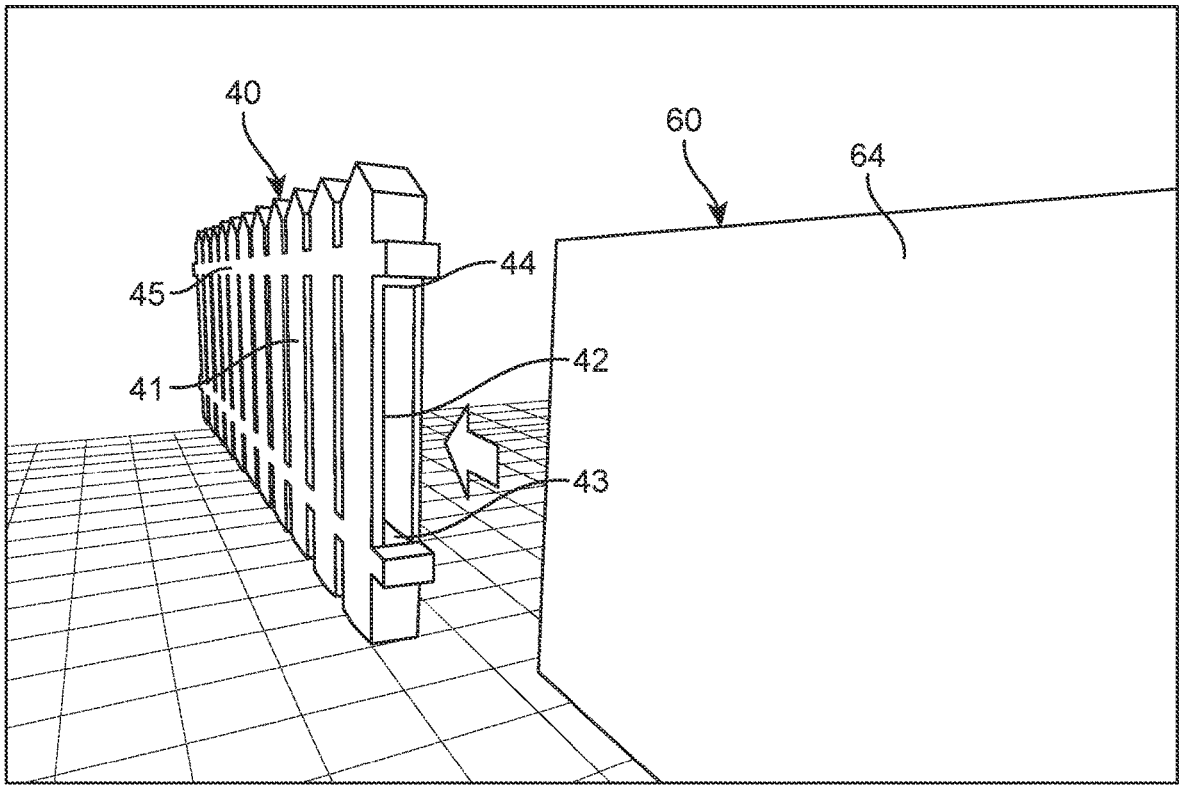
FIG. 2 shows pane opening 42 of fence assembly 40 receiving pane assembly 60.

In one embodiment, best shown in FIG. 2, fence assembly 40 may include fence posts 41. The fence post 41 may include an elongated cubed body portion. The fence post 41 may also include a triangular portion capping the elongated cubed body portion. Fence posts 41 may include a bottom portion secured to the ground. Said bottom portion providing a base to stabilize each individual post in the ground. It may be suitable for the fence posts 41 to be a series of vertical posts secured to the ground. Each individual post may be secured to the ground a predetermined distance from the following post placed in the series of vertical posts. Said predetermined distance may be optimized for viewing between the fence posts 41 while maintaining structural integrity. Interlocking the series of fence posts 41 to each other may be a horizontal support 45.

The horizontal support 45 may serve as stabilization and help create the structure of fence assembly 40. It may be preferable for fence assembly 40 to include at least one horizontal support spanning across the multiple vertical fence posts 41. The horizontal support 45 spanning across the bottom portion of the fence posts may help create a bottom support 43. The horizontal support 45 spanning across the top portion may help create a top support 44. The predetermined distance between the bottom support 43 and the top support 44 may create a body portion of fence posts 41 that includes the distal borders of a pane opening 42. The pane opening 42 may be a vertical aperture that creates a through-hole through the body portion of fence posts 41. Said through-hole of pane opening 42 may be placed in alignment to a following fence posts 41 when placed in series. The alignment of the pane opening 42 between fence posts 41 may create an entryway for pane assembly 60 to be received.

Figure 3:
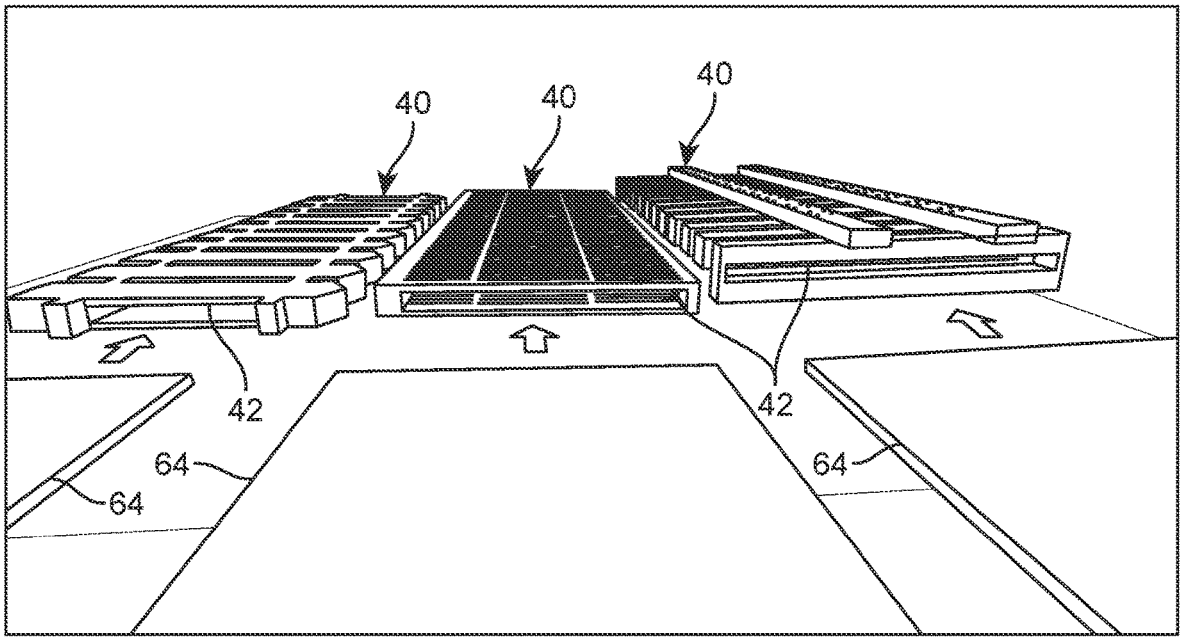
FIG. 3 illustrates multiple embodiments of fence assembly 40 receiving pane assembly 60.

As best illustrated in FIGS. 1-3 pane assembly 60 may include a pane 62. The pane 62 may be made of a glass, or plastic material and exhibit one-way viewing properties. Said pane 62 may be a rectangular sheet to be received by pane opening 41. The bottom support 43 provides a floor for pane 62 to slide through multiple fence posts 41. The pane 62 may include a reflective face 64 and a viewing face 66. As shown in FIG. 1 the reflective face 64 may be located on the exterior of fence assembly 40 that is opposite the domicile 22. The viewing face 66 may be located on the interior of the fence assembly 40 that may be viewed from the domicile 22. The orientation of the reflective face 64 and the viewing face 66 may thereby afford the user added privacy while in their domicile 22. The ratio of viewability to the reflectiveness of the pane 62 may be predetermined.

As shown in FIG. 3 it may be suitable for fence assembly 40 to have multiple embodiments with fence posts 41 and horizontal support 45 in varying thicknesses. One embodiment may include multiple fence posts 41 connected by a horizontal support 45 on either side of a middle portion. As well as a horizontal support 45 on both distal ends of fence posts 41. Thereby creating a continuous edge about a top and bottom perimeter of fence assembly 40.

Figure 4:
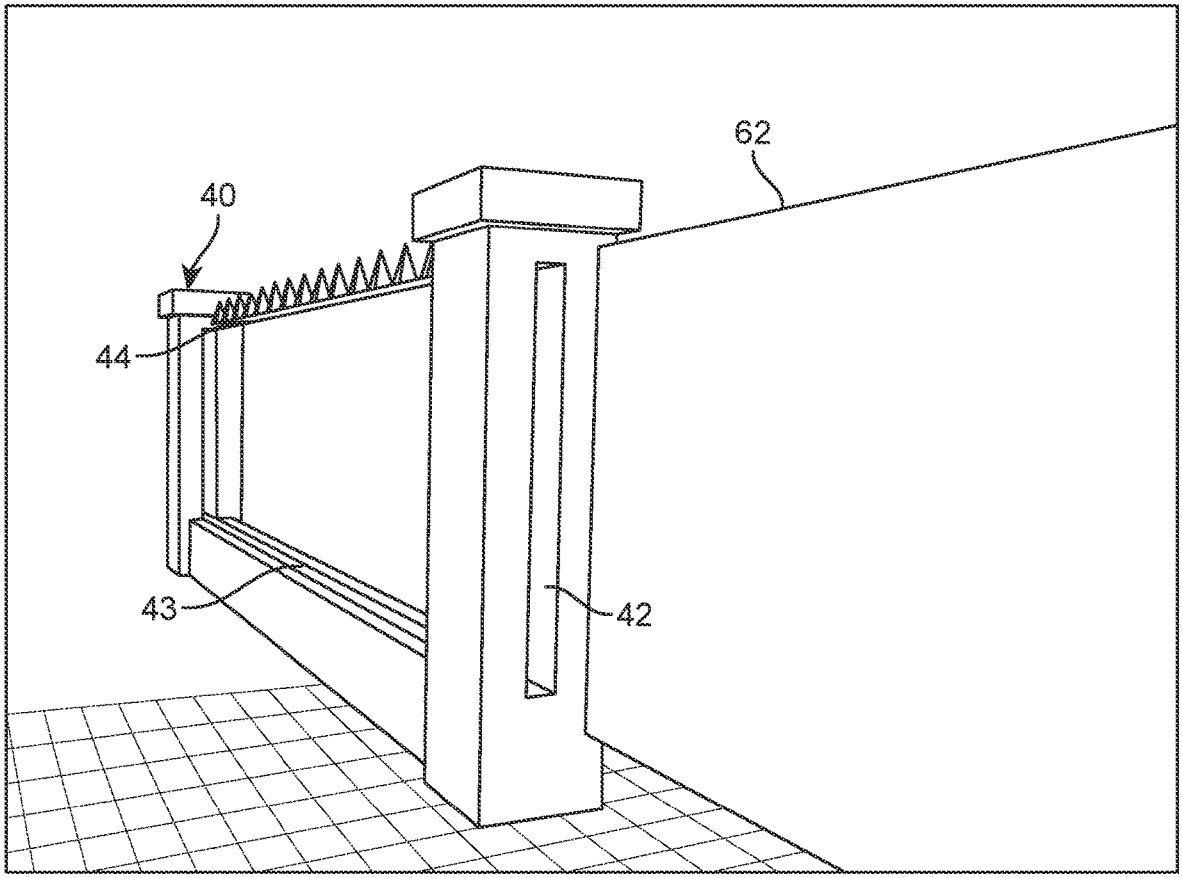
FIG. 4 is a representation of yet another embodiment of fence assembly 40.

As shown FIG. 4 this alternate embodiment of fence assembly 40 may only include two columns created by distal anchoring fence posts 41 with respect to a bottom support 43 and a top support 44. The columns of fence post 41 may include a vertical aperture creating a through-hole through a body portion of said fence posts 41. The columns of fence post 41 may include an elongated squared body portion and a squared head portion having a larger width than that of the elongated squared body portion. The bottom support 43 may include a longitudinal channel that creates a floor for pane 62 to be supported by. The top support 44 may help stabilize pane 62 in position once it has been slid into pane opening 42. The top portion of top support 44 may include a series of triangular protrusions spanning the entire length of top support 42. The minimal use of fence post 41 in this embodiment may increase user visibility through fence assembly 40 via a viewing face 66 while maintaining the desired privacy via reflective face 64.

Figure 5:
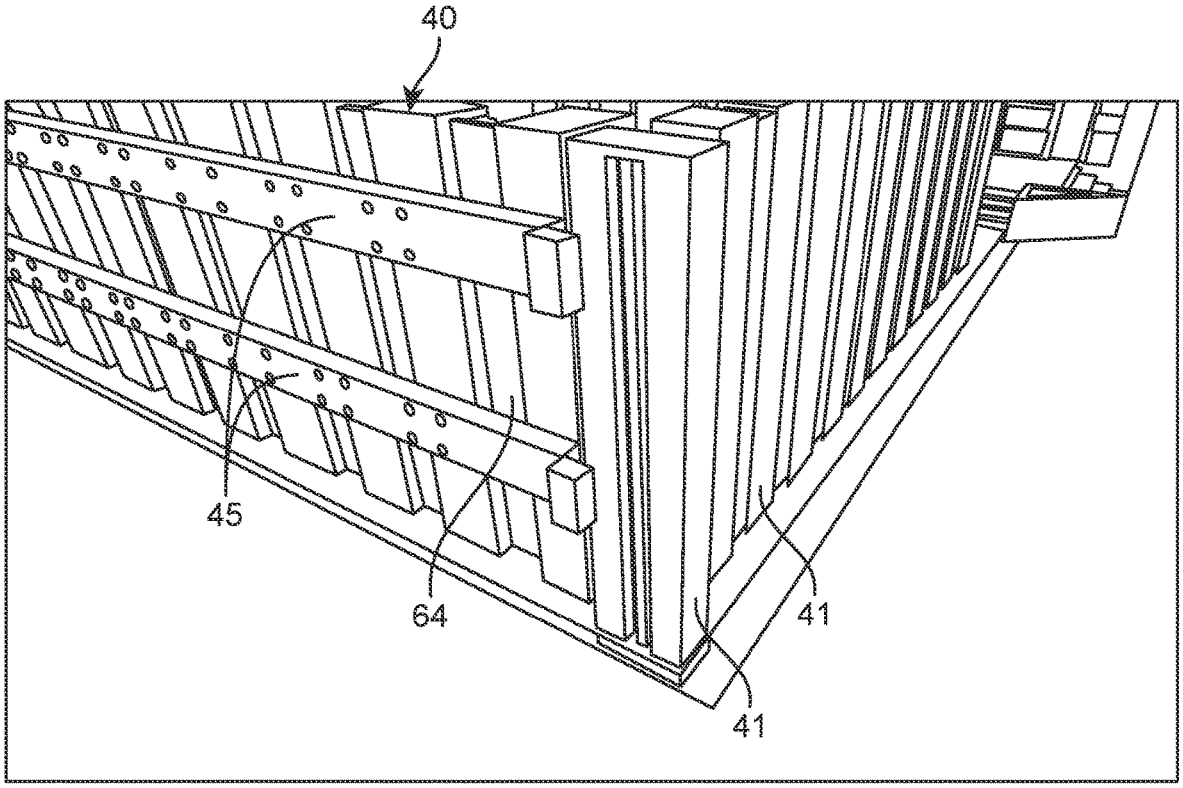
FIG. 5 depicts multiple fence assemblies 40 interlocking to define a fenced area.

As demonstrated in FIG. 5 fence assembly 40 may be segmented. As such, fence assembly 40 may be configured in an overlapping fashion. The pane opening 42 may be in constant abutting contact to the interior of the following fence assembly 40 that includes viewing face 66. This overlapping of fence assembly 40 may be continued until it defines a perimeter of domicile assembly 20. It should be understood that alternate embodiments may also include pane assembly 60 being built into the fence assembly 40 or pane assembly 60 being removable from fence assembly 40.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a fence with a one-way viewing insert, comprising:

a) a domicile;

b) a fence assembly including fence posts placed about a perimeter of said domicile, said fence posts including a pane opening, said fence posts including a top body portion, a central body portion and a bottom body portion, said pane opening being a vertical aperture, wherein said aperture spans said central body portion of the fence posts, the aperture of one fence post being placed in alignment with the aperture of a following fence post, wherein said fence posts are connected in a series via a horizontal support, wherein said horizontal support comprises a top horizontal support spanning across a top portion of said fence posts and a bottom horizontal support spanning across a bottom portion of said fence posts, wherein said bottom horizontal support spanning across the bottom portion creates a bottom support, said top horizontal support spanning across the top portion creates a top support, wherein said top support and said bottom support create a top and a bottom border of the pane opening, wherein said fence posts create two distal anchoring columns with respect to a length of the bottom support and the top support, wherein said top support includes a series of triangular protrusions spanning the entire length of said top support, wherein said bottom support includes a series of rectangular portions, wherein said bottom support is separated a predetermined distance from ground, said predetermined distance is a height of said rectangular portions, said rectangular portions form a bottom portion of said fence posts, wherein said fence posts are equidistantly spaced therebetween; and c) a pane assembly including a pane having one-way viewing properties, said one-way viewing properties being defined by the pane having a reflective face and a viewing face, wherein said pane is received by said pane opening, said reflective face being oriented on an exterior of said perimeter of the domicile, the viewing face being oriented on an interior of said perimeter of the domicile.

2. The system for a fence with a one-way viewing insert of claim 1 wherein said series of triangular protrusions comprises a triangular portion capping each individual fence post.

3. The system for a fence with a one-way viewing insert of claim 1 wherein said fence posts include the top horizontal support along a top edge of the fence posts and the bottom horizontal support along a bottom edge of the fence posts creating a continuous edge between said fence posts.

4. A system for a fence with a one-way viewing insert, consisting of:

a) a domicile;

b) a fence assembly including fence posts placed about a perimeter of said domicile, said fence posts including a pane opening, said fence posts including a top body portion, a central body portion and a bottom body portion, said pane opening being a vertical aperture, wherein said aperture spans said central body portion of the fence posts, the aperture of one fence post being placed in alignment with the aperture of a following fence post, wherein said fence posts are connected in a series via a horizontal support, wherein said horizontal support comprises a top horizontal support spanning across a top portion of said fence posts and a bottom horizontal support spanning across a bottom portion of said fence posts creating a continuous edge between said fence posts, wherein a distal end of said horizontal support extends outwardly from said fence posts defining rectangular protrusions, wherein said bottom horizontal support spanning across the bottom portion creates a bottom support, said top horizontal support spanning across the top portion creates a top support, wherein said top support and said bottom support create a top and a bottom border of the pane opening, wherein said fence posts create two distal anchoring columns with respect to a length of the bottom support and the top support, wherein said top support includes a series of triangular protrusions spanning the entire length of said top support, wherein said bottom support includes a series of rectangular portions, wherein said bottom support is separated a predetermined distance from ground, said predetermined distance is a height of said rectangular portions, said rectangular portions form a bottom portion of said fence posts, wherein said fence posts are equidistantly spaced therebetween; and c) a pane assembly including a pane having one-way viewing properties, said one-way viewing properties being defined by the pane having a reflective face and a viewing face, wherein said pane is received by said pane opening, said reflective face being oriented on an exterior of said perimeter of the domicile, the viewing face being oriented on an interior of said perimeter of the domicile.

* * * * *